United States Patent [19]

Lim et al.

[11] 4,339,331

[45] Jul. 13, 1982

[54] CROSSLINKED STARCHES AS DEPRESSANTS IN MINERAL ORE FLOTATION

[75] Inventors: Sim K. Lim, Stamford; Richard M. Goodman, Norwalk, both of Conn.

[73] Assignee: American Cyanamid Company, Stamford, Conn.

[21] Appl. No.: 213,532

[22] Filed: Dec. 5, 1980

[51] Int. Cl.[3] ..... B03D 1/06

[52] U.S. Cl. ..... 209/167; 209/5; 210/731

[58] Field of Search ..... 209/5, 166, 167; 210/731; 75/2

[56] References Cited

U.S. PATENT DOCUMENTS

| | | | |
|---|---|---|---|
| 2,364,520 | 12/1944 | Cole | 209/166 |
| 2,689,649 | 9/1954 | Atwood | 209/166 |
| 2,970,140 | 1/1961 | Mullinger | 210/731 X |
| 2,975,124 | 3/1961 | Caldwell | 210/731 |
| 3,292,780 | 12/1966 | Frommer | 209/166 X |
| 3,371,778 | 3/1968 | Iwasaki | 209/166 X |
| 3,393,168 | 7/1968 | Johnson | 209/5 X |
| 3,795,671 | 3/1974 | Wing | 336/111 |
| 3,862,028 | 1/1975 | Jones | 209/166 |
| 3,979,286 | 9/1976 | Wing | 210/731 |
| 3,990,965 | 11/1976 | Csillag | 209/5 |
| 4,139,455 | 2/1979 | Griffith | 75/2 X |

FOREIGN PATENT DOCUMENTS

| | | | |
|---|---|---|---|
| 2429428 | 11/1976 | Fed. Rep. of Germany | 209/167 |
| 688235 | 9/1979 | U.S.S.R. | 209/167 |

OTHER PUBLICATIONS

Flory, Principles of Polymer Therm., Cornell Univ. Press, 1953, pp. 32, 47, 358.

*Primary Examiner*—Robert Halper

*Attorney, Agent, or Firm*—Michael J. Kelly; Paul W. Leuzzi, II

[57] ABSTRACT

Conventional starches are chemically crosslinked for use as selective depressants in the flotation of non-sulfide mineral ores. The process employing these crosslinked starches requires lower reagent dosages, exhibits improved selectivity and recovery and exerts a lower load on existing waste treatment facilities. The crosslinking agents employed are bifunctional and are used in sufficient quantities to result in 500 to 10,000 anhydroglucose units per crosslink.

9 Claims, No Drawings

CROSSLINKED STARCHES AS DEPRESSANTS IN MINERAL ORE FLOTATION

BACKGROUND OF THE INVENTION

In mineral ore flotation, depression comprises steps taken to prevent the flotation of a particular mineral. In one-mineral flotation systems, it is commonly practiced to hold down both the gangue materials and low-assay middlings. In differential flotation systems, it is used to hold back one or more of the materials normally flotable by a given collector.

Depression is conventionally accomplished through the use of reagents known as depressing agents or, more commonly, depressants. When added to the flotation systems, the depressing agents exert a specific action upon the material to be depressed thereby preventing that material from floating. The exact mode of this action remains open to speculation. Various theories have been put forth to explain this action; some of which include: that the depressants react chemically with the mineral surface to produce insoluble protective films of a wettable nature which fail to react with collectors; that the depressants, by various physical-chemical mechanisms, such as surface adsorption, mass-action effects, complex formation, or the like, prevent the formation of the collector film; that the depressants act as solvents for an activating film naturally associated with the mineral; that the depressants act as solvents for the collecting film; and the like. These theories appear closely related and the correct theory may ultimately prove to involve elements from several, if not all, of them.

Currently, non-sulfide flotation systems have utilized depressants derived from natural substances such as starches, dextrins, gums and the like. See U.S. Pat. No. 3,292,780 to Frommer et al. and U.S. Pat. No. 3,371,778 to Iwasaki. However, from an ecological vantage point, the presence of residual depressants such as these in the waste waters increase the biodegradeable oxygen demand and the chemical oxygen demand, thereby creating a pollution problem in the disposal of these waste waters. From a commercial vantage point, there are an ever-increasing number of countries in which use of reagents having a food value, such as starch, is prohibited in commerical applications.

In the industry's effort to overcome the disadvantages inherent in systems employing natural substances, such as starch, as the depressant, various synthetic depressants have been examined. Although it is too early to accurately judge the effectiveness of these synthetic depressants, a major obstacle they will have to overcome is their exorbitant cost as compared to the natural depressants.

Accordingly, there yet exists the need for a selective depressant which can at once overcome the drawbacks of the conventional depressants derived from natural substances and yet perform in an equivalent or superior manner without incurring exorbitant expenses.

SUMMARY OF THE INVENTION

The present invention provides a process for depressing non-sulfide minerals in a flotation system. The process comprises adding to the flotation system an effective amount of a crosslinked starch or starch-containing substance having from about 500 to 10,000 anhydroglucose units per crosslink. The crosslinking is the result of reacting the starch or starch-containing substance with a bifunctional crosslinking agent under appropriate reaction conditions. The instant process depresses non-sulfide minerals as well as comparable processes employing synthetic depressants or starch depressants at dosage levels considerably less than those employed in processes utilizing starch and more economically than processes using synthetic depressants.

DETAILED DESCRIPTION OF THE INVENTION

In accordance with the instant invention there is provided a process for depressing non-sulfide minerals in a flotation system by adding to the flotation system an effective amount of crosslinked starch. Starches, or starch-containing natural substances, which can be utilized in the instant invention include, but are not limited to, corn, waxy corn, waxy maize, tapioca, potato, sorghum, wheat, rice, sago, amylomaize, arrowroot and the like. Additionally, starches, such as those listed above, which have been modified may be utilized. Examples of various modifications include starches which have been acidified, oxidized, fluidized, enzyme converted, dextrinized, esterified, etherified, grafted, block polymerized and the like. What is meant by these terms is, in esterification for example, the starch is reacted with acetic anhydride or maleic anhydride to become esterified.

The starch or modified starch is crosslinked with an appropriate bifunctional crosslinking agent. Suitable crosslinking agents able to react with two or more hydroxyl groups include phosphorus oxychloride, trimetaphosphates, epichlorohydrin, dicarboxylic acid anhydride, N,N'-methylenebisacrylamide; 2,4,6-trichloro-s-triazine and the like. The degree of crosslinking should be such that there are 500 to 10,000 anhydroglucose units (AGU) per crosslink. To obtain this level of crosslinking about 0.001 to 0.15 percent, based on the starch, of crosslinking reagent should be employed, preferably 0.01 to 0.15 percent.

The crosslinking agent is added to a granular starch suspension generally having a solids content on the order of 35 to 45%. The crosslinking reaction lasts from one to twenty-four hours at a temperature within the range of 10° to 110° C. with the pH controlled between pH 7 to 12. If the suspension is a swelling one, such as an aqueous suspension, the swelling under strongly alkaline conditions can be controlled by the presence of high concentrations (10 to 30%) of sodium chloride or sulfate. The swelling of the starch results from the alkali hydroxide, ammonium hydroxide, amine or alkali carbonate generally employed to maintain the pH. Conditions under this reaction are generally chosen to prevent gelatinization so that the reaction product can be isolated in granule form.

To obtain a higher degree of substitution, the crosslinking reaction may be carried out in a non-swelling suspension, such as isopropanol, or by blending the reagents with a starch having a 5 to 20% moisture content without any suspending medium. Additionally, the crosslinking reaction can occur in a cooked aqueous starch solution where the starch has gelatinized; in this reaction the temperature must be maintained between 60° and 100° C., and the gelatinized starch can also be dried on a heated drum.

Although the effective amount of the crosslinked starch necessary to obtain effective depression may vary depending upon the mineral to be treated, the degree of substitution and similar variables, generally an effective amount will be 0.25 to 2.5 pounds of crosslinked starch per ton of ore and preferably 0.5 to 1.5 pounds per ton of ore. The ores which can be treated are believed to be all non-sulfide ores with special emphasis being given to the separation of siliceous gangue particles from oxidic iron values, of copper minerals from molybdenite, of galena from chalcopyrite and sphalerite, of apatite from ilmenite, of fluorspar from calcite and of sylvite from halite in the presence of clays.

The following specific examples illustrate certain aspects of the present invention and, more particularly, point out methods of evaluating the process for depressing non-sulfide minerals in a flotation system. However, the examples are set forth for illustration only and are not to be construed as limitations on the present invention except as set forth in the appended claims. All parts and percentages are by weight unless otherwise specified.

EXPERIMENTAL PROCEDURE

Step 1: Grinding

600 Parts of crude iron ore having a particle size of minus 10 mesh are mixed with 400 ml. of deionized water, 5.0 ml. of a 2% sodium silicate "N" solution and 1.8 ml. of a 25% NaOH solution.

The resulting mixture is subjected to grinding in a rod mill for 50 minutes and thereafter is transferred into a 8 liter cylinder. To this cylinder there are added 200 ml. of 0.05% $Ca(OH)_2$ solution and an amount of deionized water sufficient to fill the cylinder to the 8 liter mark.

Step 2: Desliming

The cylinder mixture is subjected to mechanical stirring for 1 minute during which time there is added 6.9 parts of a 1% causticized corn starch solution (0.011 NaOH based on starch) as the desliming aid. The stirring is then stopped and the mixture is allowed to settle for 12 minutes, after which approximately 7 liters of the supernatant layer is syphoned off and filtered, resulting in the slime product.

Step 3: Rougher Float

The remaining 1 liter underflow is transferred to a flotation bowl and water containing 17 ppm of calcium as $CaCO_3$ is added to the bowl until the level reaches the lip. The pulp is briefly agitated at 1200 rpm and thereafter the pH is adjusted to approximately 10.6 through the addition of 5–10 drops of 10% NaOH. 27.3 Parts of a 1% causticized starch solution is then added as a depressant and a two-minute conditioning time is allowed.

4.9 Parts of a 1% solution of a commercially available collector is added, 30 seconds of conditioning is allowed followed by a four-minute float. After the float, 3.3 parts of a 1% solution of a commercially available collector is added, 30 seconds of conditioning is allowed followed by a four-minute float. After the float, 3.3 parts of a 1% solution of a commercially available collector is again added, 30 seconds of conditioning is allowed and then followed by a second four-minute float.

The froth collected from the first and second floats is labeled the rougher float and the remainder in the flotation bowl is labeled the rougher concentrate.

Step 4: Scavenger Float

The rougher float is transferred to a second flotation bowl to which there is added 13.6 parts of a 1% causticized corn starch solution as a depressant. Two minutes of conditioning is allowed before air is introduced into this bowl for 3–4 minutes. The froth collected is labeled the final froth.

Step 5: Middling Float

The underflow from the scavenger float is further conditioned for 30 seconds with 1.4 parts of a 1% solution of a commercially available collector and thereafter floated for 3 minutes. The middling float sequence is repeated a second time and the combined froth from these two float is labeled the middling froth. The underflow remaining is combined with the rougher concentrate and labeled the concentrate.

COMPARATIVE EXAMPLE A

The Experimental Procedure set forth above is followed in every material detail employing as the depressant 1.5 pounds of causticized starch per long ton of iron ore in the flotation steps. Test results are set forth in Table I.

COMPARATIVE EXAMPLE B

The Experimental Procedure set forth above is followed in every material detail employing as the depressant 0.75 pound of causticized starch per long ton of iron ore in the flotation steps. Test results are set forth in Table I.

EXAMPLE 1

The Experimental Procedure set forth above is followed in every material detail employing as the depressant 1.5 pounds of crosslinked starch per long ton of iron ore in the flotation steps wherein the crosslinked starch is an ethoxylated cornstarch crosslinked with epichlorohydrin and mixed with 7.7% NaOH in a blender for 15 seconds. Test results are set forth in Table I.

EXAMPLE 2

The procedure of Example 1 is followed in every material detail except that 0.75 pound of crosslinked starch is employed as the depressant are set forth in Table I.

COMPARATIVE EXAMPLE C

The Experimental Procedure set forth above is followed in every material detail employing as the depressant 1.5 pounds of ethoxylated corn starch mixed with 7.7% NaOH in a blender for 15 seconds per long ton of iron ore in the flotation steps. Test results are set forth in Table I.

EXAMPLE 3

The procedure of Example 1 is followed in every material detail except that 1.0 pound of crosslinked starch is employed as the depressant per long ton of iron ore. Test results are set forth in Table II.

EXAMPLE 4

The procedure of Example 3 is followed in every material detail except that the crosslinked cornstarch is mixed with 2% NaOH and blended for 5 seconds. Test results are set forth in Table II.

TABLE I

DESLIMING-FLOTATION PERFORMANCE OF OXIDIZED IRON ORE

TABLE I-continued

| Example | Dose lb/LT | Weight % Slime | Concentrate | Final Froth | Middl. Froth | Calculated Head | % Fe Assay Slime | Conc. | Final Froth | Middl. Froth |
|---|---|---|---|---|---|---|---|---|---|---|
| Comp. A | 1.5 | 21.56 | 41.89 | 32.51 | 4.03 | 35.52 | 10.8 | 66.5 | 12.2 | 34.5 |
| 1 | 1.5 | 18.22 | 44.68 | 32.95 | 4.14 | 36.40 | 9.0 | 65.8 | 12.4 | 30.9 |
| Comp. C | 1.5 | 18.02 | 38.04 | 36.25 | 7.69 | 36.54 | 9.4 | 67.8 | 14.3 | 51.1 |
| Comp. B | 0.75 | 18.37 | 39.22 | 37.54 | 4.85 | 36.68 | 9.1 | 67.7 | 16.2 | 49.2 |
| 2 | 0.75 | 21.46 | 41.19 | 32.87 | 4.47 | 36.23 | 10.1 | 67.7 | 14.3 | 39.6 |

| Example | Insol Conc. | Fe Distribution Slime | Conc. | Final Froth | Middl. Froth | Type of Causticized Starch | % NaOH Based on Starch |
|---|---|---|---|---|---|---|---|
| Comp. A | 4.21 | 6.53 | 78.40 | 11.5 | 3.91 | Corn Starch | 0.011 |
| 1 | 5.67 | 4.50 | 80.77 | 11.21 | 3.50 | Ethoxylated corn crosslinked | 7.7 |
| Comp. C | 3.51 | 4.62 | 70.58 | 14.17 | 10.62 | Ethoxylated Corn non-crosslinked | 7.7 |
| Comp. B | 3.83 | 4.55 | 72.38 | 16.57 | 6.49 | Corn Starch | 0.011 |
| 2 | 4.45 | 5.96 | 76.18 | 12.47 | 4.88 | Ethoxylated crosslinked starch | 7.7 |

TABLE II

DESLIMING-FLOTATION PERFORMANCE OF OXIDIZED IRON ORE

| Example | Dose lb/LT | Weight % Slime | Concentrate | Final Froth | Middl. Froth | Calculated Head | % Fe Assay Slime | Conc. | Final Froth | Middl. Froth |
|---|---|---|---|---|---|---|---|---|---|---|
| 3 | 1.0 | 20.6 | 35.9 | 36.5 | 7.0 | 36.43 | 10.0 | 67.0 | 19.3 | 46.9 |
| 4 | 1.0 | 22.5 | 31.4 | 37.8 | 8.3 | 36.62 | 9.9 | 67.8 | 23.0 | 53.1 |

| Example | Insol Conc. | Fe Distribution Slime | Conc. | Final Froth | Middl. Froth | Type of Causticized Starch | % NaOH Based on Starch |
|---|---|---|---|---|---|---|---|
| 3 | 3.35 | 5.65 | 66.01 | 19.32 | 9.00 | Ethoxylated crosslinked corn | 7.7 |
| 4 | 2.85 | 6.09 | 58.14 | 23.76 | 12.01 | Ethoxylated crosslinked corn | 2.0 |

EXAMPLE 5

When the Experimental Procedure set forth above is employed in the flotation process wherein copper is separated from molybdenite, depression performance substantially equivalent to that achieved in an iron ore flotation system is obtained employing a N,N'-methylenebisacrylamide crosslinked amylomaize starch.

EXAMPLE 6

When the Experimental Procedure set forth above is employed in the flotation process wherein galena is separated from chalcopyrite and sphalerite, depression performance substantially equivalent to that achieved in an iron ore flotation system is obtained employing an epichlorohydrin crosslinked dextrinized potato starch.

EXAMPLE 7

When the Experimental Procedure set forth above is employed in the flotation process wherein apatite is separated from ilmenite, depression performance substantially equivalent to that achieved in an iron ore flotation system is obtained employing a trimetaphosphate crosslinked sorghum starch.

EXAMPLE 8

When the Experimental Procedure set forth above is employed in the flotation process wherein fluorspar is separated from calcite, depression performance substantially equivalent to that achieved in an iron ore flotation system is obtained employing an epichlorohydrin crosslinked etherified rice starch.

EXAMPLE 9

When the Experimental Procedure set forth above is employed in the flotation process wherein sylvite is separated from halite and clay, depression performance substantially equivalent to that achieved in an iron ore flotation system is obtained employing a N,N'-methylenebisacrylamide crosslinked tapioca starch.

We claim:

1. A process for depressing non-sulfide minerals in a flotation system which comprises adding to the flotation system, as a selective depressant, an effective amount of a crosslinked starch or starch-containing substance having from about 500 to 10,000 anhydroglucose units per crosslink.

2. The process of claim 1 wherein the starch is selected from the group consisting of corn starch, waxy corn starch, tapioca starch, potato starch, sorghum starch, wheat starch, rice starch, sago starch, amylomaize starch and arrowroot starch.

3. The process of claim 2 wherein the starch has been modified by either acidification, oxidation, fluidization, enzyme conversion, dextrinization, esterification, etherification, graftation, or block polymerization.

4. The process of claim 1 wherein 0.001 to 0.15 percent, based on the starch, of a crosslinking reagent is employed to crosslink the starch, which latter starch product can be in the original granular form, as an aqueous dispersion or in a drum dried form.

5. The process of claim 4 wherein the crosslinking agent is selected from the group consisting of epichlorohydrin, N,N'-methylenebisacrylamide, 2,4,6-trichloro-s-triazine, dicarboxylic acid anhydrides, phosphorus oxychloride and trimetaphosphates.

6. The process of claim 1 wherein the selective depressant is an epichlorohydrin crosslinked cornstarch.

7. The process of claim 6 wherein the non-sulfide mineral is oxidized iron ore.

8. The process of claim 1 wherein the non-sulfide mineral is oxidized iron ore.

9. The process of claim 1 wherein the effective amount is from about 0.25 to 2.5 pounds of crosslinked starch per ton of ore.

* * * * *